United States Patent [19]

Turecek

[11] Patent Number: 4,503,784

[45] Date of Patent: Mar. 12, 1985

[54] DOOR CLOSURE ASSEMBLY FOR INCINERATORS, FURNACES, AND OVENS

[75] Inventor: Bozena Turecek, Brampton, Canada

[73] Assignee: Trecan, Ltd., Mississauga, Canada

[21] Appl. No.: 495,100

[22] Filed: May 16, 1983

[51] Int. Cl.[3] ..... F23M 7/00

[52] U.S. Cl. ..... 110/176; 49/360; 110/172; 110/181; 126/192; 126/197; 202/242; 432/250

[58] Field of Search ..... 110/172, 173 R, 176, 110/177, 181; 432/250; 126/190, 192, 194, 197; 48/124; 49/324, 360; 202/242, 250, 251

[56] References Cited

U.S. PATENT DOCUMENTS

| | | | |
|---|---|---|---|
| 2,744,858 | 5/1956 | Homan | 110/173 R |
| 3,864,875 | 2/1975 | Hewitt | 49/360 |
| 3,944,472 | 3/1976 | Lowe | 202/251 |
| 4,016,820 | 4/1977 | Johnson et al. | 110/173 R |
| 4,406,619 | 9/1983 | Oldengott | 110/173 R |

*Primary Examiner*—Edward G. Favors
*Assistant Examiner*—Steven E. Warner
*Attorney, Agent, or Firm*—Murray, Whisenhunt & Ferguson

[57] ABSTRACT

A closure arrangement for an incinerator or cremator in which the door and the opening in the incinerator are complementary wedge-shapes is described. The door can be automatically lowered by a hydraulic actuator to close the opening by a wedging action in the vertical direction. The seal is enhanced by a sealing strip fastened around the periphery of the door which is compressed between the door and the opening when the door is closed. A hinge is connected between the door and the actuator which allows it to move laterally as well as vertically so that it can fit snugly into the opening. The door can also be raised to close the opening. In the case of large heavy doors the hinge can be omitted and the door may be raised or lowered using guides.

9 Claims, 5 Drawing Figures

DOOR CLOSURE ASSEMBLY FOR INCINERATORS, FURNACES, AND OVENS

The present invention relates to a closure arrangement particularly, but not exclusively, for use with incinerators and cremators.

With incinerators and cremators the emission control requirements to be satisfied are rigorous, particularly if pathological waste is to be burned. A two stage incinerator or cremator is commonly used which has a first stage in which the waste is burned by semi-pyrolysis and a second stage in which the volatile products produced from the semi-pyrolysis, for example combustible gases (CO, $H_2$, etc.) and possibly particulate matter, are completely combusted at a high temperature. The combustion products are then discharged to atmosphere directly or via some heat recovery stage. A two stage process is used because the velocity of the particulate matter from semi-pyrolysis stage is relatively low and the combustion of this matter can then be completed so that emissions can be controlled.

One common problem with such incinerators and cremators is lack of air control caused by poor sealing of the incinerator or cremator door. This leads to an ingress of uncontrolled air which will increase the combustion rate and produce high velocity emissions which are difficult to regulate. In fact, such increased high velocities will cause a carry over of solid matter into the secondary combustion chamber, or afterburner and this excess solid matter may be too much for the combustion chamber to cope with the result that solid matter may be present in the emissions.

Various remedies to overcome this problem of poor door sealing have been proposed. One such proposal utilize a rail and roller door closing system in which as the door was brought into register with the opening by an 's', bend in the rails and thereby closed the opening. This system worked reasonably well although air leakage was still present due to difficulty in manufacturing the components to achieve close tolerances. In addition, the system was mechanically complex to manufacture and use and resulted in increased costs. Another proposal utilized a recessed door with side face seals however, this required that steel was set against steel which again did not provide a satisfactory seal. In addition the thermal behaviour of dissimilar materials resulted in larger gaps between the door and the opening and consequently increased air leakage. This problem was attempted to be overcome by providing a guillotine at the bottom of the door which, when closed would snugly engage a recess. However, air leakage at the top and sides of the door was still a problem and the complexity of manufacture was considered a drawback as was the expense.

It is an object of the present invention to obviate or mitigate the abovesaid disadvantages.

The above disadvantages are remedied by providing a door movable in a substantially vertical direction and an opening in a wall of the incinerator which is adapted to be closed by the door using the principle of sealing wedges.

In a preferred embodiment the door and the incinerator opening are complementary wedge-shapes, the door has a hinged joint at its upper end so that its weight can cause it to be moved laterally with respect to the opening thereby adapting it to be fitted closely to the incinerator opening to provide a substantially air tight seal around the periphery of the door.

Embodiments of the present invention will now be described by way of example with reference to the accompanying drawings in which.

Figure 2:
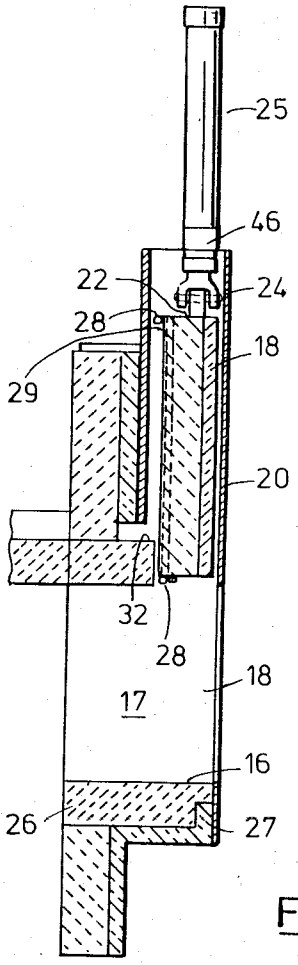
FIG. 2 is a cross-sectional view of FIG. 1 taken on the line A—A in the direction of the arrows.
Figure 1:
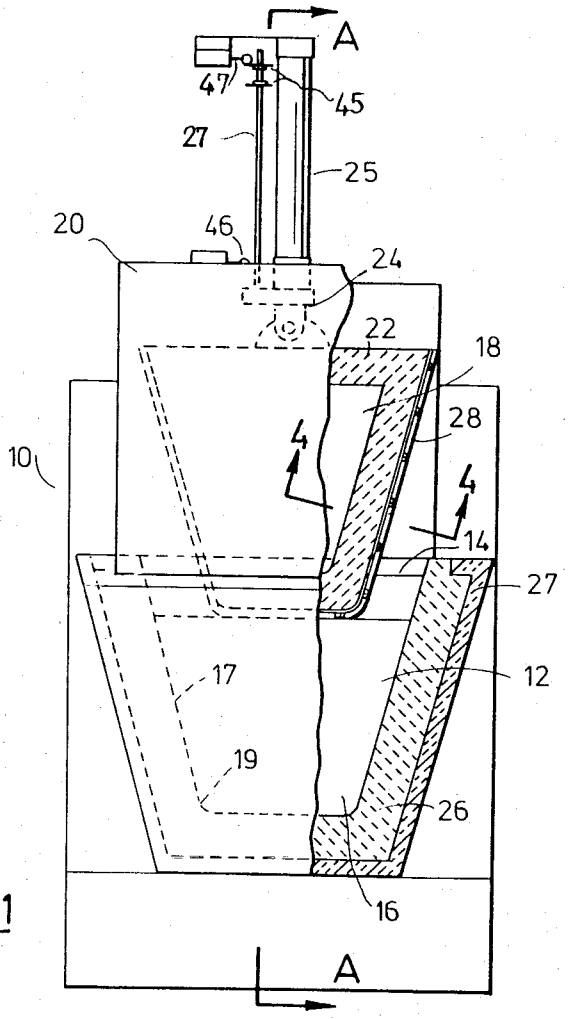
FIG. 1 is a front elevation partly cut away of part of an incinerator with incinerator door open.
Figure 3B:
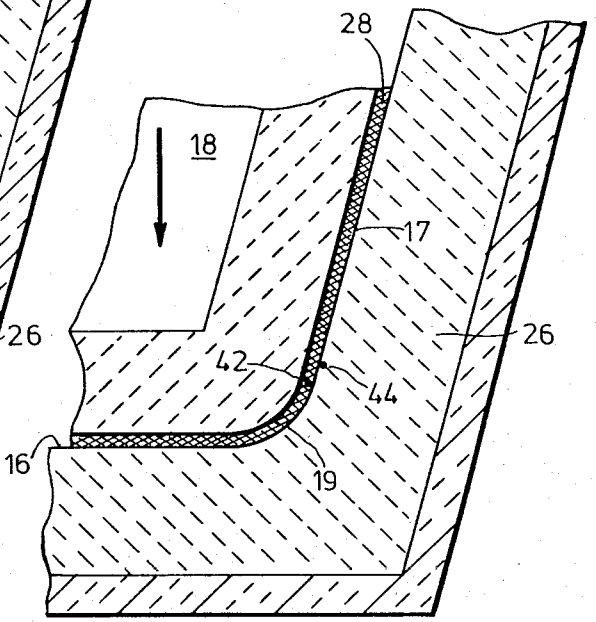
Figure 3A:
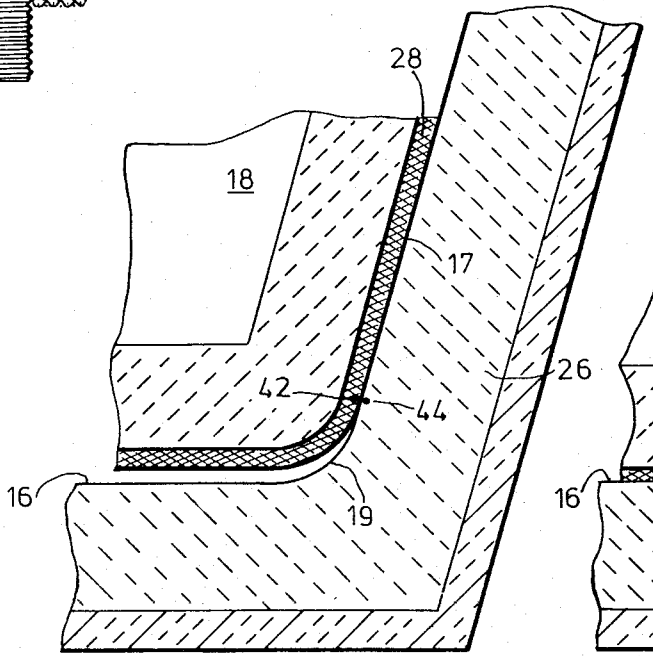
Figure 4:
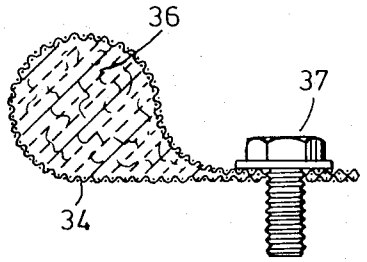

FIG. 3*a* is an enlarged view of part of FIG. 1 showing the door closing to form a seal with the opening;

FIG. 3*b* is a view similar to FIG. 3*a* with the door in a closed position; and FIG. 4 is a cross-sectional view taken on the line 4—4 of FIG. 1 and shows the seal of FIGS. 1, 2, 3*a* and 3*b*.

Referring now to FIG. 1 of the drawings an incinerator or cremator has a front section 10 which a wedge-shaped opening 12 is provided. The opening 12 is wider at the top 14 than the bottom 16 and tapers from the top to the bottom by straight side faces of wall 17 which are blended into the bottom 16 by curved portions 19. The general shape of the opening may be referred to as a wedge-shaped trapezoidal. The incinerator door 18 is a complementary wedge shape to the opening 12 and in the open position the door is covered by a front plate 20. The door is connected at its upper end 22 by a hinged joint 24 to a hydraulic actuating system generally denoted by the numeral 25 which can be operated to raise or lower the door 18 with respect to the opening 12. The incinerator opening 12 has a steel surround lined with a castable refractory material 26 which is four inches thick, this in turn being surrounded by a two inch thick layer of a thermal insulating block 27.

The door 18 is made of steel and is also lined with a castable refractory material which is, however, less dense than the material 26. The door 18 carries a seal 28 around its periphery which when the door is closed, is compressed between the door 18 and the sides 17 and bottom 16 of the opening 10 and is also compressed between the upper end of the rear face 29 of the door and a lip portion 32 on the front wall of the incinerator just above the opening 12. When the door is lowered into complete engagement with the opening the compression of the seal 28 is such that the closure is substantially airtight. The seal 28 is shown in more detail in FIG. 4 and comprises a high temperature Inconnel(-Trade mark) alloy mesh 34 formed into a loop which contains asbestos fibre material 36. The alloy mesh 34 is fastened to the door 18 by carbon steel bolts 37.

The angle which the sides of the door and the opening make with the vertical is 15° which has been found, in practice, to be the most suitable angle for optimizing the seal.

In use, the operation of the door from an open position to a closed position is as follows; in response to an actuating signal from a controller (not shown) the hydraulic system causes the door 18 to move downwards. During closing the relationship between the door and the opening as shown in FIG. 3*a* arises; due to manufacturing tolerances and general downward and lateral movement of the door due to the hinge 24, one point 42 on the seal 28 engages a point 44 on the wall 19 of the opening 12. As the door 18 continues to close the hinge 24 permits the door to be centered in the opening 12 and the sides of the seal 28 rubs against sides 17 of the opening over a predetermined distance which acts to compress the seal 28 when the door is closed as shown in FIG. 3*b* and a substantially airtight seal is formed between the opening and the door. This direct contact distance is kept to an optimum minimum sufficient to compress the seal yet prevent mechanical damage. In order to open the door the reverse procedure is followed; the seal becomes uncompressed and the sides may again rub against each other until the actuator raises the door to such an extent that it is lifted free from contacting the sides of the opening.

Limit switches 46, 47 are positioned at different ends of the hydraulic actuating system 25. A rod 27 is mounted parallel to the system 25 and carries projections 45 to trip the switches at predetermined positions. The projections are adjustable on the rod 27 and to limit the extent of the door moving upwards respectively to check whether the door 18 seals the opening 12 properly. These limit switches 46, 47 control lights which illuminate to indicate an improper seal. If the door closes and the seal is damaged and for some reason the lights do not operate, then this will be indicated to the operator by difficulty in controlling the temperature in the primary chamber.

Various modifications may be made to the closure arrangement as hereinbefore described without departing from the scope of the invention. For instance, the closure arrangement may comprise a door which wedges against an opening in the upward direction in the situation where the height of the environment is limited. In such a case the wedge would have a pivot point located above its center of gravity so that it would be supported on the actuating means but able to move laterally so that a snug fit would be obtained in a similar manner to the door described in the preferred embodiment.

With very large and heavy doors the hinged connection could be omitted and the door arranged to be raised or lowered on guides, in such a case it is anticipated that there would be a pair of actuating and guiding arrangements spaced across the door. In this case the tolerances have to be greater so that the wedging action between the door and the opening is achieved without substantial frictional contact between the sides as is the case in the preferred embodiment since there is no self-centering arrangement.

The actuating system may be pneumatic or electrical as well as hydraulic and the materials used for the opening and the door can be replaced by others with similar thermal and mechanical properties. In this respect the surround may be a refractory plastic material. The opening and closing process can be automated to work on a timing circuit which is pre-programmed to load and operate the incinerator or furnace. The limit switch 46 can be set to be actuated at different positions of door closure to compensate for the seal wearing or retaining a compression set. The limit switch 47 can also be adjusted to be actuated by the projection at different door open positions.

This invention provides considerable advantages over the prior art; the door and the opening are straightforward and inexpensive to manufacture; a seal is provided on all sides of the door and the door can be operated by various types of actuating systems; because of the nature of operation of the door it operates in the same direction as its weight is directed and the hinge causes the door to be self-aligning, therefore the operation of the incinerator/cremator can be carefully controlled to satisfy emission requirements, and replacement of seal is a simple low cost operation.

I claim:

1. A closure assembly for use with an incinerator or furnace, the furnace having a vertical wall defining an opening therein, a portion of the wall extending outwardly from the plane of the wall and defining, in a generally vertical plane, a furnace sealing structure for receiving a door moveable in a vertical direction, the structure having a recess with an open end at the top and having sides converging from the open end to a generally horizontal base;

a door of a complementary shape to the structure and moveable in the vertical direction in the same vertical plane as the structure between the open end and the base;

door moving means coupled to the door for raising and lowering the door to define respective open and closed positions, the door being coupled to the door moving means by a pivotable connection at the top of the door which permits the door to self-center as it is closed; and compressible sealing means provided around convergent sides, base and front of the door which when the door is fully closed is compressed to form a substantially gastight seal between the door and the opening;

whereby when the door is lowered by said door moving means into the closed position, the door self-centers and the sides of the door engage the sides of the structure in a wedging action, the sealing means being compressed when the door fully closes the opening.

2. Closure assembly as claimed in claim 1 wherein the pivotable connection is above the center of gravity of the door so as to permit the door to self-center as it is moved to close the opening.

3. A closure assembly as claimed in claim 2 wherein the pivotable connection is hinge means located on the top of the door.

4. A closure assembly as claimed in claim 3 wherein the door and the structure are trapezoidal in shape and the door has a base region and converging sides, the base of the structure and the base region of the door merging into the respective converging sides of the structure and the door by curved side portions.

5. A closure as claimed in claim 4 wherein the converging sides of the door and structure are at an angle of substantially 15 degrees to the vertical.

6. A closure assembly for use with an incinerator or furnace, the furnace having a vertical wall defining an opening therein, said closure assembly comprising a furnace sealing structure lying in a generally vertical plane for receiving a door moveable in a vertical direction, said structure having an open end and sides converging from the open end to a base region having sides, a door of a generally complimentary shape to the structure mounted in the same vertical plane as the structure, said door being moveable between the open end and the base region to define respective open and closed positions, door moving means coupled to the door for moving the door between said open and closed positions, said door being suspended from the door moving means at a point of suspension above the center of gravity of the door, said point of suspension permitting the door to self-center as it is moved to close the opening, said point of suspension being hinge means located at the top of the door, said open end being at the top of the structure, and said base region being at the bottom of the structure, said door and said structure being trapezoidal in shape and said door having a base region and converging sides, said base regions of said structure and said door merging into the respective converging sides of said structure and said door by curved side portions, said converging sides of said door and said structure being at an angle of substantially 15 degrees to the vertical, and further comprising sealing means provided around one of the sides of the door or structure, said sealing means being compressible between the structure and the door when the opening is closed by the door, said opening being sealed when the door is moved by said door moving means to said closed position so that said door engages the converging sides and the sides of the base region by a wedging action to form a substantially gas-tight seal, said sealing means comprising an alloy mesh, said alloy mesh being formed into a loop defining a channel therein, a ceramic fiber material being provided within the channel, said sealing means being fastened to one of said door and said opening around its periphery by a plurality of fasteners.

7. A closure assembly for use with an incinerator or furnace, the furnace having a vertical wall defining an opening therein, said closure assembly comprising a furnace sealing structure lying in a generally vertical plane for receiving a door moveable in a vertical direction, said structure having an open end and sides converging from the open end to a base region having sides, a door of a generally complimentary shape to the structure mounted in the same vertical plane as the structure, said door being moveable between the open end and the base region to define respective open and closed positions, door moving means coupled to the door for moving the door between said open and closed positions, control means associated with the door moving means for controlling movement of the door, said door moving means and control means being incorporated into a time control sequence which is pre-programmed to load and operate the incinerator or furnace, said door being closed and opened automatically in accordance with signals received by the door moving means from the control means during this time controlled sequence, said opening being sealed when the door is moved by said door moving means to said closed position so that the door engages the converging sides and the sides of the base region by a wedging action to form a substantially gas-tight seal.

8. A closure assembly as claimed in claim 7 including means for providing an indication of the quality of seal obtained when the door is closed, said means comprising a limit switch and an indicator connected thereto whereby said limit switch actuates said indicator when said door does not close the opening within a certain distance.

9. A closure assembly as claimed in claim 8 wherein the position of the door at which the limit switch is actuated is also adjustable whereby the certain distance can be varied.

* * * * *